United States Patent [19]

Smith et al.

[11] 4,438,714

[45] Mar. 27, 1984

[54] RADIUS BLADE CUTTING APPARATUS FOR A SEWING MACHINE

[75] Inventors: Samuel W. Smith, Carlisle; Harold C. McVey, Paris, both of Ky.

[73] Assignee: Blue Grass Industries, Inc., Carlisle, Ky.

[21] Appl. No.: 325,347

[22] Filed: Nov. 27, 1981

[51] Int. Cl.[3] ..... D05B 65/02

[52] U.S. Cl. ..... 112/130; 83/600; 83/699; 112/128; 112/261; 112/272; 112/301

[58] Field of Search ..... 83/600, 607, 699, 698; 112/130, 124 R, 122, 272, 285, 289, 294, 297, 301, 261, 124 P, 125, 126–129; D8/57

[56] References Cited

U.S. PATENT DOCUMENTS

| | | | |
|---|---|---|---|
| D. 101,791 | 11/1936 | Rauh | D8/57 |
| 1,511,616 | 10/1924 | Kendall | 112/294 X |
| 1,592,115 | 7/1926 | Lindgren | 112/294 X |
| 3,122,184 | 2/1964 | Larson | 83/600 X |
| 3,237,501 | 3/1966 | Hottendorf | 83/699 X |
| 3,581,716 | 6/1971 | Teed | 112/294 X |
| 3,851,605 | 12/1974 | Rockeratti | 112/130 |
| 4,125,228 | 11/1978 | Brewer | 83/698 |
| 4,269,127 | 5/1981 | Kamiya | 112/261 X |

*Primary Examiner*—Werner H. Schroeder
*Assistant Examiner*—Andrew M. Falik
*Attorney, Agent, or Firm*—Willian, Brinks, Olds, Hofer, Gilson & Lione, Ltd.

[57] ABSTRACT

Two blade members are counter-rotated from a rest position to a cutting position in which radially directed cutting surfaces cooperate to snip a strip of material by a shearing action as the strip of material flows from a sewing machine or other processing machine. The blade members are reversible and are biased against each other to ensure positive cutting. A hinge-like linkage permits an offset between the blade members and power means to increase versatility. The cutting apparatus can include sensing means to permit automatic cutting of a completed workpiece from an excess of a strip of material which is sewn to the workpiece during the manufacture of a garment.

14 Claims, 14 Drawing Figures

FIG. 7
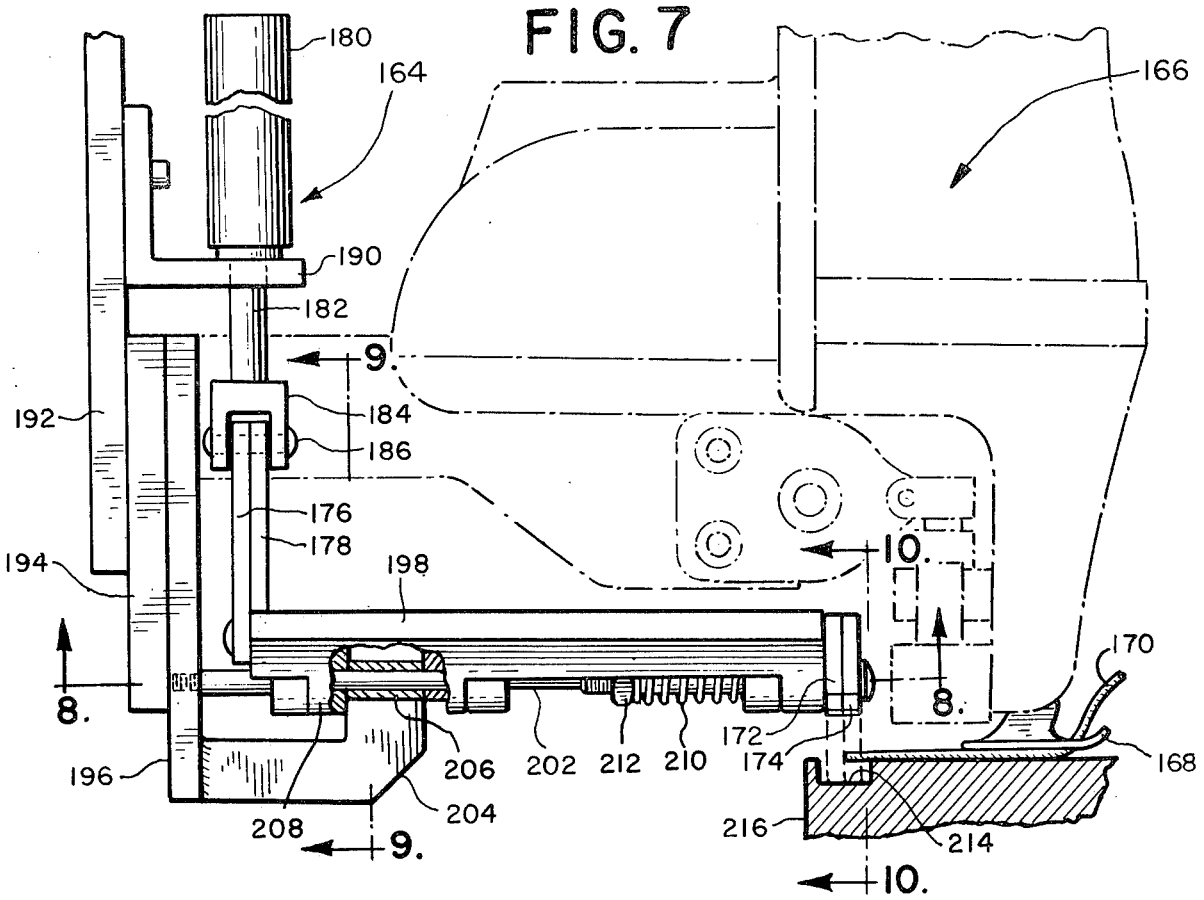
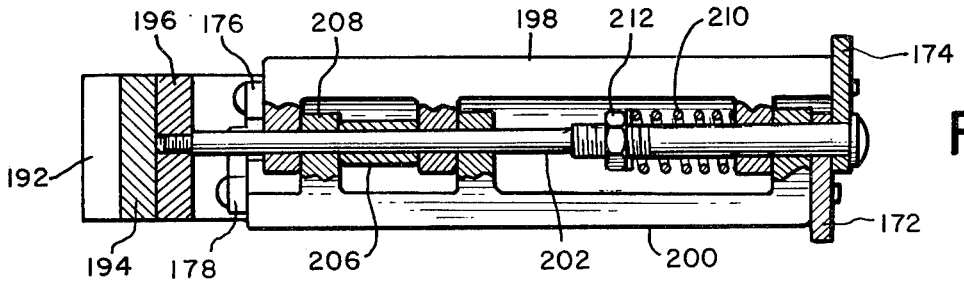
FIG. 8
FIG. 9
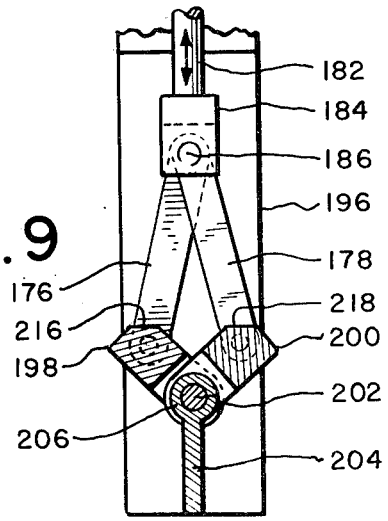
FIG. 10
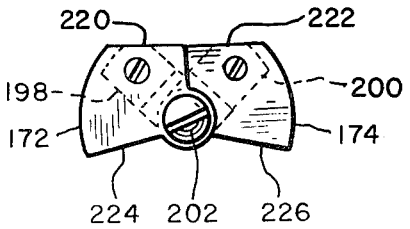

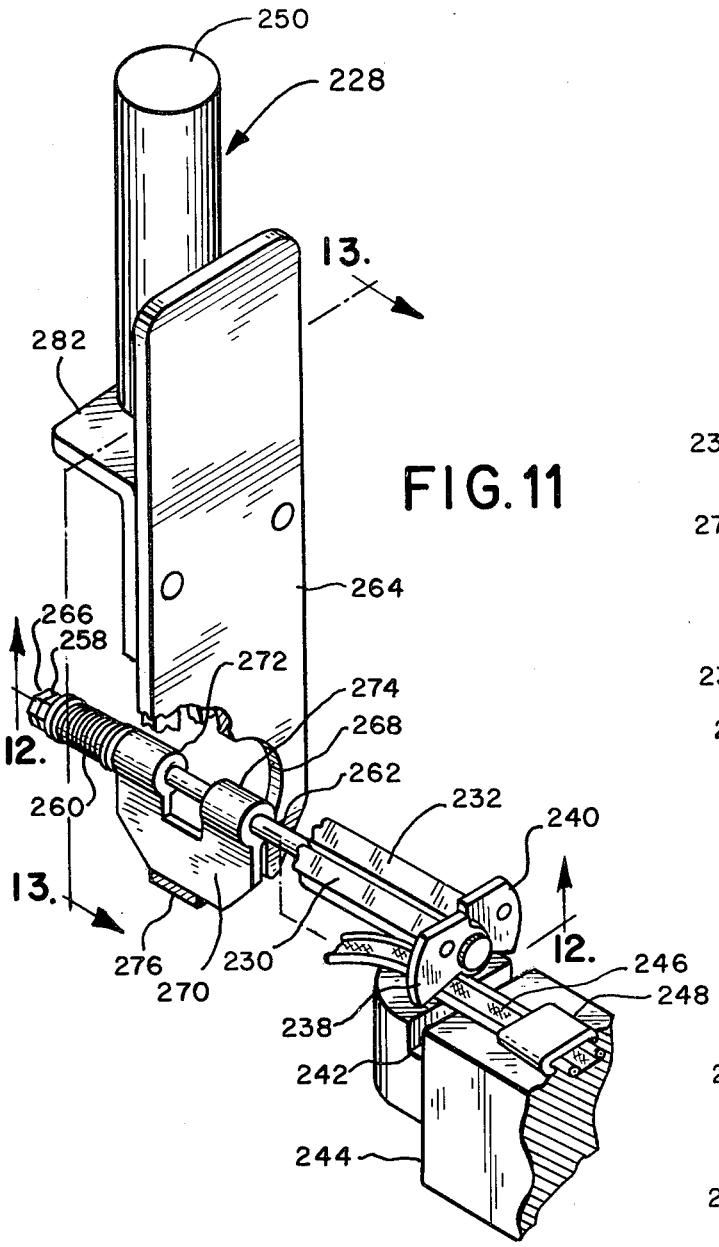
FIG. 11
FIG. 13
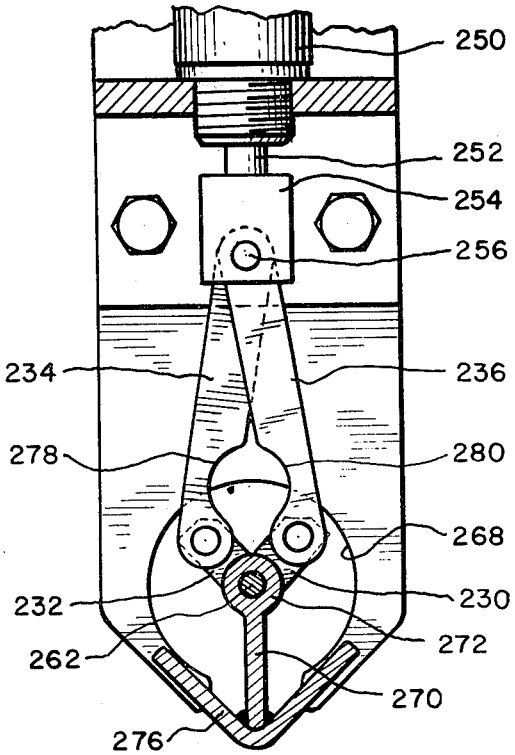
FIG. 14
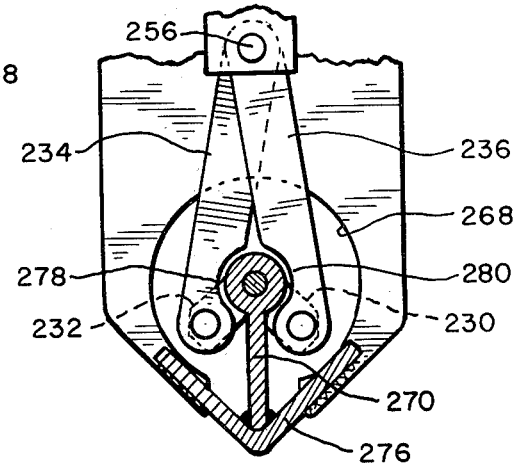
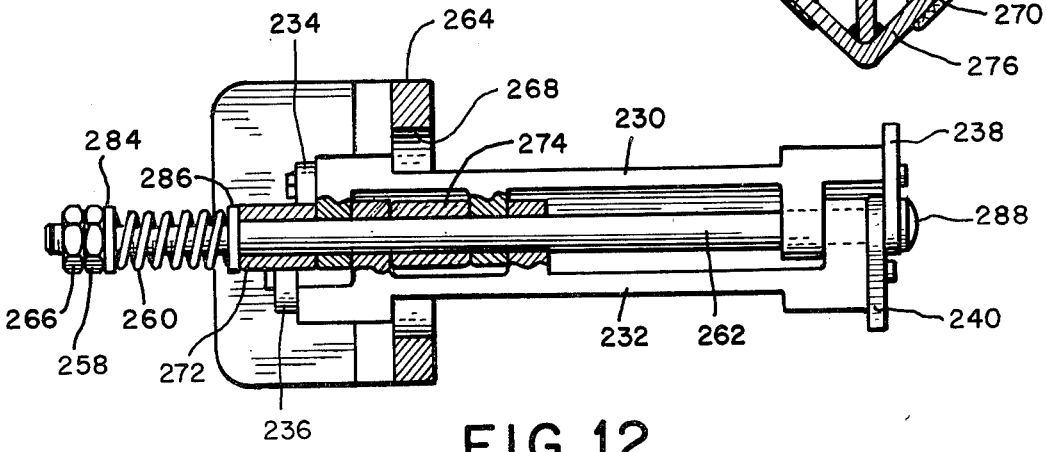
FIG. 12

RADIUS BLADE CUTTING APPARATUS FOR A SEWING MACHINE

BACKGROUND OF THE INVENTION

The present invention is directed to an apparatus for cutting a length of material as it flows from a machine and, more particularly, to a radius blade cutting apparatus which automatically cuts a length of material upon completion of a manufacturing operation. The invention is especially useful with sewing machines as used in the manufacture of garments.

In manufacturing a garment, various specialized sewing machines are used for efficient assembly of particular pieces of cloth and for stitching of particular seams. For example, in sewing a binding tape or other strip of material over a raw seam of a partially completed garment or workpiece, a specialized machine may feed the strip of material from a spool into a presser foot for stitching to a workpiece which is passed under the presser foot. This type of sewing machine may be equipped with one of the available cutting devices to permit automatic cutting of the workpiece from the excess strip of material and the excess thread after stitching of the workpiece is completed.

Generally, two types of devices for automatically cutting the workpiece from the excess strip of material and the excess thread are available. In one, a chopper blade and anvil are mounted upon the head and arm of the sewing machine, respectively, so as to chop the material upon actuation of a fluid cylinder. In another, a knife blade is pivotally mounted on the head of the sewing machine so as to engage a stationary blade mounted on the arm of the sewing machine upon actuation of a fluid cylinder. Generally, other types of cutting devices are not used in such machines due to the limited space available and the need to leave the throat of the sewing machine unobstructed for manipulation of the workpiece under the presser foot.

Although these available automatic cutting devices have significantly improved the efficiency of various garment manufacturing operations, the devices are unreliable in numerous sewing operations. Also, the chopper blade and anvil type device may break the arm or a portion of the arm off the sewing machine. Further, the knife blade type device is difficult to align and maintain in necessary alignment because the blades are mounted upon separate parts of the machine. And, both types of devices result in considerable expense and downtime when damaged or worn out cutting surfaces are renewed. Additionally, in many particular sewing machine applications, there is inadequate space for such devices without interference with operation of the machine.

It is, therefore, an object of the present invention to provide an apparatus for automatically cutting a workpiece from the excess strip of material sewn thereto without the difficulties inherent with the blade and anvil or the pivoting blade and stationary blade devices now available.

Another object of the present invention is to provide a cutting apparatus which is suitable for many diverse applications, particularly those machine applications where there is inadequate space for the available cutting devices, for cutting a strip of material as it flows from a machine.

It is still another object of the present invention to provide a cutting apparatus for cutting a strip of material as it flows from a machine such that positive cutting is achieved with a minimum of alignment requirements and without risk of injury to an operator of the machine.

It is still another object of the present invention to provide a cutting apparatus having reversible blades and other features to minimize machine downtime and other expenses of forming, installing, and renewing the cutting surfaces.

SUMMARY OF THE INVENTION

The present invention is directed to an improved processing machine of the type which processes a length of material. A pair of blade members is rotatably mounted on a common blade axis which is substantially parallel to and spaced from the length of material to be cut. Each of the blade members includes a cutting surface which is directed substantially radially with respect to the blade axis, such blade members being characterized as "radius blades." Each blade member is rotatable between a rest position allowing passage of the material and a cutting position. The cutting apparatus further includes moving means for effecting coordinated counter-rotation of the blade members from the rest position to the cutting position such that the cutting surfaces cooperate to snip the length of material by a shearing action.

In the preferred embodiments described herein, the moving means includes elongated blade driving arms and other linkage means operable to ensure that each of the blade members rotates substantially simultaneously from the rest position to the cutting position. Each of the blade driving arms is pivotally mounted at one end upon an off-set, crank portion of a blade member and is pivotally joined to the other blade driving arm at the other end upon a pivot pin which is movable toward and away from the blade member axis by power means. The blade members are preferably flat, and, because no blade angle or relief is used in forming the cutting surfaces, the blades can be simply and economically formed and sharpened. Further, the blades are readily reversible so as to provide either two or four alternative cutting surfaces upon each blade.

The apparatus of the present invention can be mounted upon a sewing machine in combination with sensing and actuating means to provide automatic cutting of a workpiece from an excess strip of material and the excess thread following a sewing operation. As shown by the particular embodiments described herein, the present invention can be adapted to the limited space available upon specialized forms of sewing machines to provide the desired automatic cutting. Further, the apparatus can include simple guard devices to shield an operator from the movement of the blade members and the linkage means without interfering with the automatic cutting or sewing operations. The cutting apparatus can be conveniently powered by a fluid cylinder, a solenoid, or other similar power means to effect positive cutting.

As a result of the present invention, a strip of material flowing from a machine such as a sewing machine can be cut reliably and automatically without the need for constant realignment of blade members as is typical of currently used pivoting blade and stationary blade type devices. Unlike the anvil and blade type devices now used, the cutting apparatus of the present invention does not have a tendency to break the end off the arm of the machine. Further, because the cutting surfaces of the blade members are directed substantially radially with respect to the blade axis, the strip of material to be cut does not tend to slide along the blade members and away from the blade axis as would occur with a more conventional scissor-like design having blades which are not radially directed.

Further objects, features, and advantages of the present invention will become apparent from a consideration of the following description, the appended claims, and the accompanying drawing.

BRIEF DESCRIPTION OF THE DRAWINGS

FIG. 7 is a front elevation of a second embodiment of the present invention as mounted upon a flatlock machine, portions of which are shown in phantom;

FIG. 8 is a bottom view of the embodiment of the present invention shown in FIG. 7;

FIG. 9 is a sectional view of the embodiment shown in FIG. 7 taken along line 9—9 of FIG. 7.

FIG. 10 is a sectional view of the embodiment shown in FIG. 7 taken along line 10—10 of FIG. 7;

FIG. 11 is a perspective view of a third embodiment of the present invention showing portions of a flatlock machine upon which the embodiment is mounted;

FIG. 12 is a sectional view of the embodiment shown in FIG. 11 taken along line 12—12 of FIG. 11;

FIG. 13 is a sectional view of the embodiment shown in FIG. 11 taken along line 13—13 of FIG. 11; and FIG. 14 is a sectional view like that of FIG. 13 but showing the embodiment of FIG. 11 in the cutting position.

DESCRIPTION OF THE PREFERRED EMBODIMENTS

Figure 1:
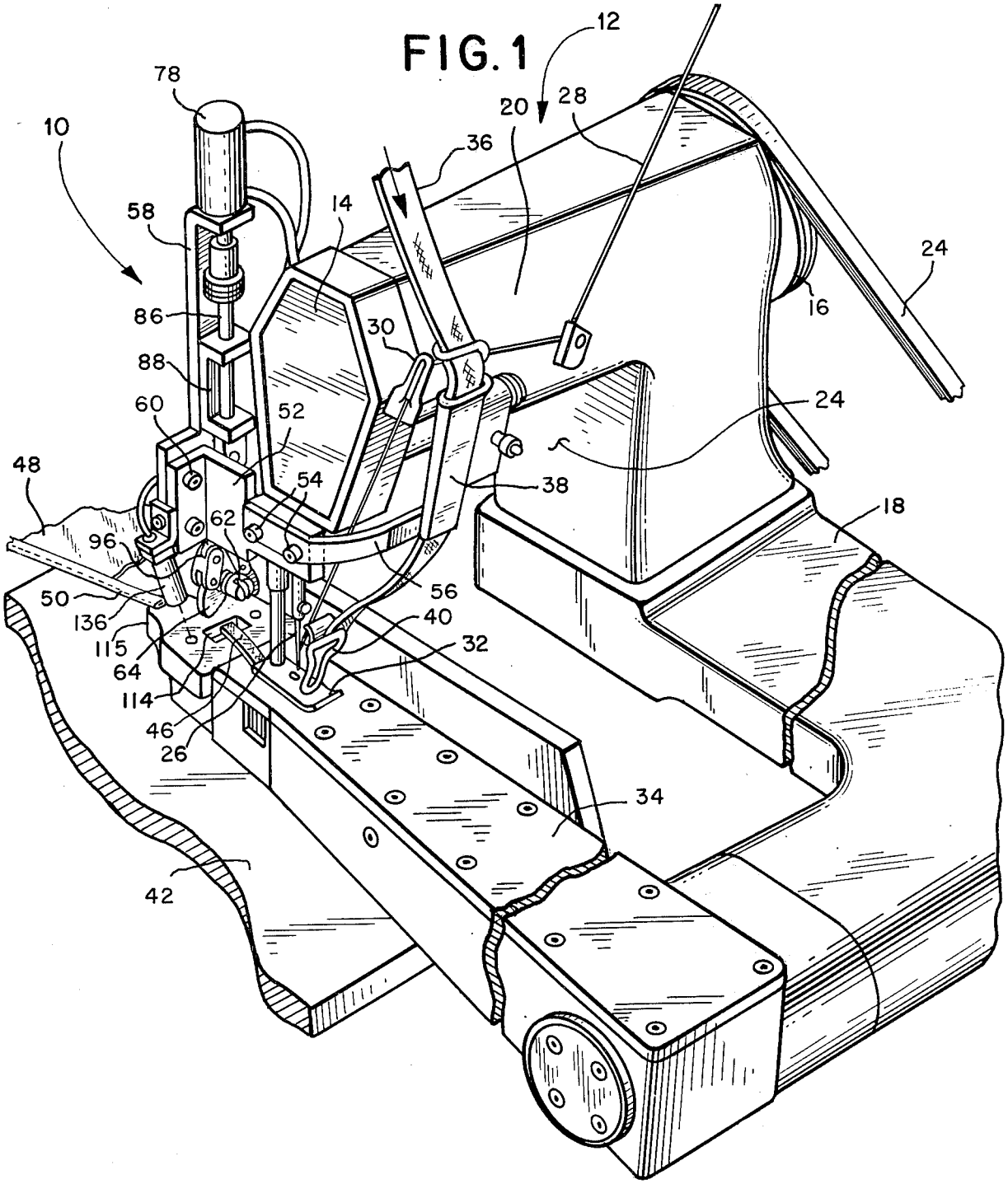
FIG. 1 is a perspective view of a tape shoulder machine equipped with a first preferred embodiment of the present invention, the safety guard having been removed to show the cutting apparatus.

With reference to the drawings, a preferred embodiment of the cutting apparatus of the present invention, indicated generally by the numeral 10, is shown in FIG. 1 as mounted upon a tape shoulder machine, indicated generally by the numeral 12.

The tape shoulder machine 12 is a specialized form of sewing machine which includes a machine head 14 at the front of the machine, a drive pulley 16 at the back of the machine, and a machine base 18 which is supported by conventional means at a convenient working height. Other portions of the tape shoulder machine 12 are a machine neck 20, a machine throat 22, and a drive belt 24 connected to a motor, not shown. A sewing needle 26 receives thread 28 from a thread guide 30 and passes the thread 28 vertically through a presser foot 32.

Unlike more conventional sewing machines, the tape shoulder machine 12 includes a long cantilevered machine arm 34, extending from the right end of the machine to the presser foot 32, which is particularly adapted for sewing a strip of fabric tape 36 upon the shoulder seam of a garment. The fabric tape 36 is fed from a tape spool, not shown, through a tape guide 38, to a tape folding device 40 which folds the fabric tape 36 to prevent fraying of the fabric tape 36 on the completed garment. The fabric tape 36 then passes under the presser foot 32 in a direction from right to left as shown in FIG. 1.

In the operation of the tape shoulder machine 12, a workpiece such as a partially completed shirt is manipulated into the machine at the machine throat and over the machine arm 34 while the presser foot 32 is in a raised position. A worktable 42 assists in supporting the workpiece. The presser foot 32 is then lowered upon the shoulder seam over which the fabric tape 36 is to be sewn, and a feed dog, not shown, under the presser foot 32 pulls the workpiece to the presser foot 32 upon activation of the feed dog by an operator. The operator guides the workpiece into the presser foot 32 such that the fabric tape 36 is stitched over the shoulder seam of the workpiece.

Operation of the feed dog and the sewing needle 26 are continued after stitching of the fabric tape 36 to the workpiece is completed. As shown in FIG. 1, this creates an umbilical-like connection 46 between the completed workpiece 48 and the fabric tape 36 and the thread 28. The umbilical-like connection 46 is then cut adjacent the presser foot 32 to separate the completed workpiece 48 from the excess fabric tape 32 and the excess thread 28, leaving a short pigtail 50 of folded and stitched fabric tape which is trimmed in a later manufacturing operation.

The cutting apparatus 10 of the present invention is mounted directly upon the machine head 14 by an angle mounting bracket 52 which is fixed by cap screws 54. The cap screws 54 may also be used to secure the tape guide 38 to the machine head 14 by means of a tape guide mounting bracket 56. A generally vertical support member 58 is mounted upon the angle mounting bracket 52 by cap screws 60 so as to be generally perpendicular to and slightly above the path of the stitched fabric tape 36 as it leaves the presser foot 32 and moves from right to left as shown in FIG. 1.

Figures 2, 3, 4, 5:
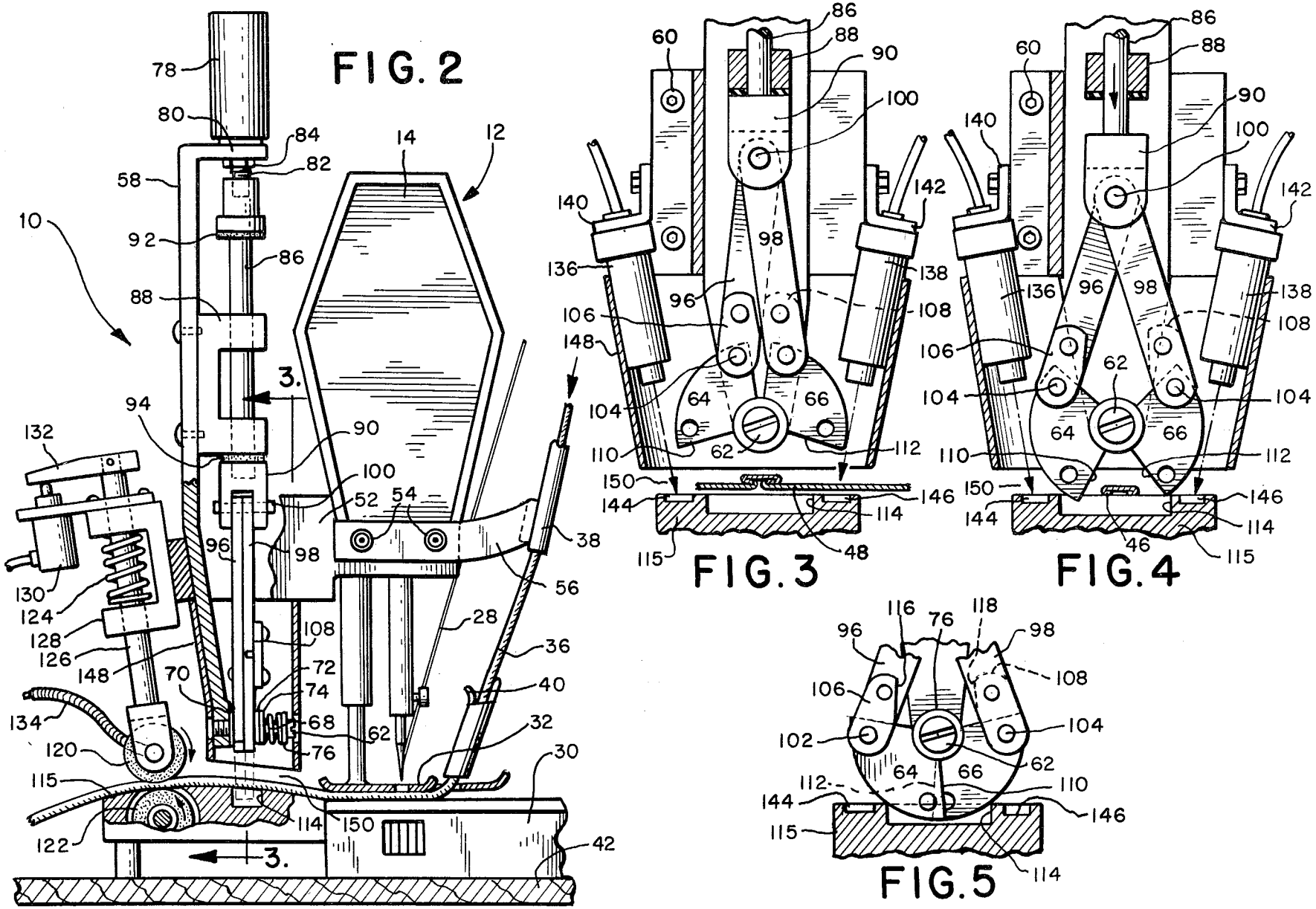
FIG. 2 is a front elevation of portions of the tape shoulder machine of FIG. 1, with portions broken away, showing the blade members of the embodiment in the rest position.
FIG. 3 is a right elevation of portions of the sewing machine of FIG. 1, partially in section, showing the blade members of the embodiment in the rest position.
FIG. 4 is a right elevation corresponding to the view of FIG. 3 but showing the blade members of the embodiment in an intermediate position between the rest and cutting positions.
FIG. 5 is a right elevation corresponding to the view of FIG. 3 but showing the blade members of the first embodiment in the cutting position.

As shown in greater detail in FIGS. 2 and 3, the support member 58 provides a stationary threaded mounting for a pivot screw 62 which is aligned generally parallel to and somewhat above the path of the stitched fabric tape 36. A pair of pie shaped blade members 64 and 66 are rotatably mounted at their apex points upon the pivot screw 62. A helical compression spring 68 is positioned under the head of the pivot screw 62 to provide adjustable biasing of the blade member 64 against the blade member 66. Preferably, brass washers 70 and 72 are positioned between the support member 58 and the blade member 64 and between the blade member 66 and the compression spring 68, respectively, to provide bearing surfaces. Steel washers 74 and 76 are provided at the ends of the compression spring 68, as shown in FIG. 2.

Actuation of the blade members 64 and 66 from the rest position shown in FIGS. 2 and 3 is provided by a fluid cylinder 78 which is mounted upon a horizontal cylinder mounting bracket 80 welded to the support member 58. A piston rod 82 is displaced downward through a cylinder mounting collar 84 upon the application of fluid pressure to the fluid cylinder 78. A push rod 86 is threaded over the end of the piston rod 82 and passes through both legs of a U-shaped guide block 88 which is fixed to the vertical support plate 58 by machine screws. A push rod yoke 90 is fixed to the lower portion of the push rod 86, and bumper stops 92 and 94 are provided between the push rod assembly and the upper and lower surfaces of the guide block 88, respectively.

Two blade driving arms 96 and 98 are pivotally mounted upon the push rod yoke 90 by means of a common pivot pin 100 which is aligned parallel to the pivot screw 62. The blade driving arms 96 and 98 extend downward from the pivot pin 100 and are pivotally mounted upon the blade members 64 and 66 by blade pivot pins 102 and 104, respectively. The fluid cylinder 78 is mounted upon the support member 58 so as to be directed perpendicular to the path of the stitched fabric tape 36 as it leaves the presser foot 32. It will be appreciated that the fluid cylinder 78, operating through the piston rod 82 and push rod 86, moves the common pivot pin 100 toward the pivot screw 62 in response to fluid pressure.

The blade pivot pins 102 and 104 are off-set with respect to a line through the common pivot pin 100 and the pivot screw 62 such that the blade members 64 and 66 serve as cranks to simultaneously effect counterrotation of the blade members 64 and 66 in response to vertical displacement of the common pivot pin 100. Arm yoke plates 106 and 108 are fixed by machine screws to the blade driving arms 96 and 98, respectively, to provide increased support for the blade members 64 and 66. The arm yoke plates 106 and 108 help maintain alignment of the blade members 64 and 66 in a plane which is perpendicular to the path of the stitched fabric tape 36 as it leaves the presser foot 32.

The blade members 64 and 66 include respective cutting surfaces 110 and 112 which are directed substantially radially with respect to the axis of the pivot screw 62. Upon actuation of the fluid cylinder 78, the blade members 64 and 66 are rotated in opposite directions from the rest position shown in FIGS. 2 and 3 to the intermediate position shown in FIG. 4 and, thereafter, to the cutting position shown in FIG. 5. In moving to the cutting position, the cutting surfaces 110 and 112 penetrate a narrow channel 114 formed in an extension 115 of the machine arm 30 so as to intersect the path of the stitched fabric tape 36 as it leaves the presser foot 32.

Because the cutting surfaces 110 and 112 are directed substantially radially with respect to the axis about which they pivot, the cutting surfaces 110 and 112 effect shearing along their entire length almost simultaneously so as to reduce the tendency of the umbilical-like connection 46 to slide along the blade members 64 and 66 instead of being cut by the blade members 64 and 66. Thus, the cutting action is significantly different from that of a conventional pair of scissors. The arm yoke plates 106 and 108 are flattened along their inside edges 116 and 118, as shown in FIG. 5, to provide clearance for the blade driving arms 96 and 98 in the rest position and to provide a stop ensuring that the blade pivot pins 102 and 104 are maintained in the desired off-center position.

Material puller rollers 120 and 122 are counterrotated in the directions indicated by arrows in FIG. 2 to prevent slack and maintain the umbilical-like connection 46 in position beneath the blade members 64 and 66 after stitching of the workpiece 48 is completed. The roller 120 is biased against the stitched fabric tape 36 and the roller 122 by a helical compression spring 124 acting through a push rod 126 having a yoke 128. The push rod 126 passes through the legs of a U-shaped guide block 128 which is fixed to the machine head 14 or, alternatively, to the support member 58. A fluid cylinder 130, fixed to the guide block 128, engages an arm 132 to selectively raise the roller 120. Rotation of the roller 120 is provided by a flexible cable 134.

The blade members 64 and 66 are immediately returned to the rest position upon cutting of the umbilical-like connection 46 by retraction of the push rod 86 and the piston rod 82. This retraction of the blade members 64 and 66, in combination with the raising of the roller 120 by the fluid cylinder 130, permits a second workpiece to be fed into the machine throat 22 and over the machine arm 34 immediately following completion of a first workpiece. In the preferred embodiment shown, a push-type air cylinder is used which includes an integral retraction spring to retract the piston rod 82 and the blade members 64 and 66.

Photosensors 136 and 138 are fixed to the support member 58 by angle mounting brackets 140 and 142 and are directed against reflective targets 144 and 146, respectively. The photosensors 136 and 138 sense the absence of the workpiece 48 and thereupon trigger actuation of the fluid cylinder 78. The photosensors 136 and 138 also serve as safety devices by ensuring that the blade members 64 and 66 are not actuated when an object is adjacent to the folded and stitched strip of fabric tape 32 and in the path of the cutting surfaces 110 and 112. To further prevent injury to an operator, a shield 148 is mounted over the support plate 58 so as to enclose the blade driving arms 96 and 98 and the blade members 64 and 66, leaving only a narrow opening 150 for manipulation of the workpiece 48.

Figure 6:
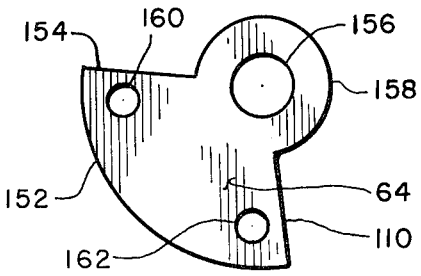
FIG. 6 is a detail view of one of the blade members of the embodiment of FIGS. 1–6.

FIG. 6 shows the configuration of the blade member 64 in greater detail. An arcuate portion 152, the cutting surface 110, and an alternative cutting surface 154 define the generally pie-shaped perimeter. The cutting surface 110 and the alternative cutting surface 154 are radial with respect to the arcuate portion 152 and are in alignment with an apex hole 156 for mounting the blade member 64 upon the pivot screw 62. A circular portion 158 surrounding the apex hole 156 provides a bearing surface for the blade member 66 and the brass washer 72 and serves to maintain alignment of the blade member 64 in a plane perpendicular to the stitched fabric tape 36. A first circumferential hole 160 receives the pivot pin 104 of the blade driving arm 96 to rotate the cutting surface 110 into cutting position.

Preferably, the blade member 64 is formed of flat tool steel which is heat treated and surface ground. The thickness of the blade member 64 is uniform and the cutting surface 110 and the alternative cutting surface 154 are ground at 90° to the orientation of the blade member 64, no relief or angle being required. A second circumferential hole 162, symmetrical with the first circumferential hole 60, permits the blade member 64 to be reversed front to back (from the position shown in FIG. 6) upon the pivot pin 104 and the pivot screw 62. Two additional cutting positions result if the blade driving arms 96 and 98 are also repositioned. In this way, the blade member 64 provides four alternative 90° cutting edges which can be used sequentially to renew sharpness of the blade member without replacement of the blade member. The blade member 66 is identical to the blade member 64 so as to further simplify forming, installing, and renewing of the cutting edges.

FIG. 7 shows a second embodiment of the cutting apparatus of the present invention, indicated generally by the numeral 164, mounted upon a flatlock machine shown in phantom and indicated generally by the numeral 166. The flatlock machine 166 includes a presser foot 168 which receives a strip of fabric tape 170 and folds the fabric tape 170 with a workpiece, not shown, which is passed under the presser foot from right to left. A needle penetrates the presser foot 170 for stitching the fabric tape 170 to the workpiece to form a flat seam.

The cutting apparatus 164 is similar to the first embodiment except that it includes a horizontal extension to clear the portions of the flatlock machine which extend to the left of the presser foot 168 as shown in FIG. 7. The cutting apparatus 164 includes blade members 172 and 174, blade driving arms 176 and 178, and a fluid cylinder 180 which operates through a push rod 182. A push rod yoke 184 includes a common pivot pin 186 upon which the blade driving arms 176 and 178 are pivotally mounted. The cutting apparatus 164 is mounted upon an angle bracket 190 and vertical mounting plates 192, 194, and 196 which are rigidly supported relative to the flatlock machine 166 by conventional means.

Unlike the first embodiment, the cutting apparatus 164 includes hinge members 198 and 200, as shown in FIGS. 8 and 9. The hinge members 198 and 200 serve as spacers between the blade members 172 and 174 and the respective blade driving arms 176 and 178 to permit the blade members to be positioned adjacent to the presser foot 168. A hinge pin 202 provides the stationary pivot point about which the blade members 198 and 200 rotate. The hinge pin 202 is threaded into the vertical support plate 196 and is further supported by a gusset 204 which is welded to the vertical mounting plate 196 and which includes an eye 206 through which the hinge pin 202 passes.

The blade members 172 and 174 and the blade driving arms 176 and 178 are fixed to the respective hinge members 198 and 200 by machine screws. Pivot portions 206 and 208 of the hinge members 198 and 200, respectively, straddle the eye 206 of the gusset 204 to further locate the hinge members 172 and 174. A helical compression spring 210 is adjustably compressed by an adjustment nut 212 to bias the blade member 172 against the blade member 174 to ensure positive cutting. A channel 214 in an extended arm 216 of the flatlock machine 166 is provided to receive the blade members 176 and 178 in the cutting position.

As shown in FIGS. 9 and 10, the hinge members 198 and 200 and the blade members 172 and 174 may be made flat along their respective upper surfaces 216, 218, 220, and 222 to provide clearance for the flatlock machine 166. The cutting surfaces 224 and 226 are approximately radial with respect to the hinge pin 202 to provide a shearing action similar to that of the first embodiment. The construction of the blade members 172 and 174 is similar to that of the blade members 64 and 66 of the first embodiment, thereby providing alternative 90° cutting edges on each of the cutting surfaces 224 and 226. However, due to the flat upper surfaces 220 and 222, only two, not four, alternative cutting edges are provided upon each of the blade members 172 and 174.

FIGS. 11–14 show a third embodiment of a cutting apparatus of the present invention, indicated generally by the numeral 228, as used with a flatlock machine. The cutting apparatus 228 is substantially the same as the second embodiment just described in that hinge members 230 and 232 serve as spacers between two blade driving arms 234 and 236 and blade members 238 and 240, respectively. The blade members 238 and 240 are counter-rotated into a channel 242 of the flatlock machine arm 244 to shear a stitched fabric tape 246 as it emerges from a presser foot 248. Actuation is provided by a fluid cylinder 250, piston rod 252, yoke 254, and pivot pin 256, upon which the blade driving arms 234 and 236 are mounted.

Unlike the second embodiment, the cutting apparatus 228 features an adjustment nut 258 which is located away from the blade members 238 and 240 and the hinge members 230 and 232. In this way the blade member 238 can be adjustably biased against the blade member 240 by the compression spring 260 from a position above and to the left of the flatlock machine and cutting apparatus 228 as shown in FIG. 11. Instead of being threaded into a vertical mounting plate as in the second embodiment, the cutting apparatus 228 includes a hinge pin 262 which passes freely through a vertical mounting plate 264. A lock nut 266 is provided against the adjustment nut 258 to ensure that adjustment is maintained.

The cutting apparatus 228 also features a relocation of the fluid cylinder 250 and the blade driving arms 234 and 236 to the side of the vertical mounting plate 264 away from the blade members 238 and 240. This requires a key-hole slot 268 in the vertical mounting plate 264 to allow rotation of the hinge members 230 and 232. A gusset bracket 270 includes eye portions 272 and 274 to provide support for the hinge pin 262. The gusset bracket 270 is welded to an angle iron reinforcement 276 which, in turn, is welded to the vertical mounting plate 264 adjacent to the key-hole slot 268. The blade driving arms 234 and 236 include notches 278 and 280, respectively, to provide clearance for the eye portion 272 when rotated to the cutting position shown in FIG. 14.

The blade members 238 and 240 are identical to the blade members 172 and 174 of the second embodiment, thus providing two alternative cutting edges per blade member. The bracketry for supporting the cutting apparatus 228 relative to the flatlock machine is similar to that of the second embodiment. Further, an angle bracket 282, similar to that of the second embodiment, is fixed to the vertical mounting plate 264 to provide a mounting for the fluid cylinder 250. As in the first embodiment, steel washers 284 and 286 are provided at the ends of the helical compression spring 260 and a brass washer 288 is positioned between the blade member 238 and the head of the hinge pin 262. Additionally, the cutting apparatus 164 and the cutting apparatus 228 may be fitted with one or more photosensors and a shield, not shown, similar to those of the first embodiment.

From the foregoing, it should be apparent that a versatile, compact, cutting apparatus for cutting a strip of material flowing from a processing machine has been disclosed. The present invention can cut reliably and automatically without the need for constant realignment of the blade members. The substantially radial cutting surfaces ensure safe and positive cutting and can be adapted for installation upon various processing machines having limited space.

Of course, it should be understood that various changes and modifications to the preferred embodiments described above will be apparent to those skilled in the art. For example, a disc spring could be used in place of the helical compression springs to provide adjustable biasing of the blade members, and other power means such as solenoids could be used in place of the fluid cylinders. Further, in addition to the embodiments described, embodiments of the present invention can be adapted for use with other specialized forms of sewing machines and other processing machines from which a length of material flows. Such changes and modifications can be made without departing from the spirit and scope of the present invention, and it is therefore intended that such changes and modifications be covered by the following claims.

We claim:

1. An improved sewing machine of the type in which a continuous strip of material is sewn to a workpiece as the workpiece is moved past a sewing needle, wherein the improvement comprises:

a pair of blade members rotatably mounted upon the sewing machine for rotation about a common blade axis substantially parallel to and spaced from the strip of material and adjacent to the needle, each of the blade members having a cutting surface which is directed substantially radially with respect to the blade axis whereby the cutting surfaces both extend along respective radii from the blade axis in order to effect shearing along their entire radial extent substantially simultaneously;

moving means for effecting coordinated counter-rotation of the blade members from a rest position allowing passage of the strip of material and the workpiece to a cutting position in which the cutting surfaces of the blade members cooperate to snip the strip of material by a shearing action after the sewing of the strip of material to the workpiece is complete and the workpiece is moved away from the path of the blade members.

2. An improved sewing machine as recited in claim 1 wherein the improvement further comprises sensing means for sensing that the sewing of the workpiece to the strip of material is complete and that the workpiece is away from the path of the blade members, the sensing means being operably connected to the moving means so as to automatically snip the strip of material without cutting the workpiece after sewing of the strip of material to the workpiece has been completed.

3. An improved sewing machine as recited in claim 2 wherein the sensing means includes at least one photosensor directed toward the path of the workpiece but directed outside the path of the strip of material, the workpiece passing the needle and the path of the blade members before being sensed by the photosensor.

4. An improved sewing machine as recited in claim 1 wherein the improvement further comprises alignment means for ensuring that the strip of material is maintained in alignment substantially perpendicular to the blade members after sewing of the strip of material to the workpiece is completed.

5. An improved sewing machine as recited in claim 4 wherein the alignment means comprises a pair of counter-rotating rollers biased against the strip of material so as to prevent the strip of material from becoming slack as the strip of material passes the blade members.

6. An improved sewing machine as recited in claim 1 wherein the improvement further comprises a shield enclosing the path of the blade members and portions of the moving means so as to prevent undesired contact with the blade members and the moving means but leaving the path of the workpiece and the path of the strip of material unobstructed.

7. An improved sewing machine as recited in claim 1 wherein the moving means includes power means and linkage means, the linkage means including a pair of elongated blade driving arms and pivot means, the blade driving arms linking the respective blade members to the pivot means, the power means being operable to move the pivot means toward the blade axis to effect counter-rotation of the blade members.

8. An improved sewing machine as recited in claim 1, wherein each of the blade members includes an alternative cutting surface which is directed substantially radially with respect to the blade axis such that each of the blade members is reversible about the blade axis so as to permit shearing of the material by the alternative cutting surface.

9. An improved sewing machine of the type in which a continuous strip of material is sewn to a workpiece as the workpiece is moved past a sewing needle, wherein the improvement comprises:

a pair of blade members rotatably mounted upon the sewing machine for rotation about a common blade axis substantially parallel to and spaced from the strip of material and adjacent to the needle, each of the blade members having a cutting surface which is directed substantially radially with respect to the blade axis;

moving means for effecting coordinated counter-rotation of the blade members from a rest position allowing passage of the strip of material and the workpiece to a cutting position in which the cutting surfaces of the blade members cooperate to snip the strip of material by a shearing action after the sewing of the strip of material to the workpiece is complete and the workpiece is moved away from the path of the blade members;

alignment means for ensuring that the strip of material is maintained in alignment substantially perpendicular to the blade members after sewing of the strip of material to the workpiece is completed;

said alignment means comprising an extension of the sewing machine for supporting the strip of material, the extension having a narrow channel for receiving the blade members in the cutting position such that the strip of material is supported by the extension above the narrow channel and the blade members are able to penetrate the narrow channel.

10. An improved sewing machine of the type in which a continuous strip of material is sewn to a workpiece as the workpiece is moved past a sewing needle, wherein the improvement comprises:

a pair of blade members rotatably mounted upon the sewing machine for rotation about a common blade axis substantially parallel to and spaced from the strip of material and adjacent to the needle, each of the blade members having a cutting surface which is directed substantially radially with respect to the blade axis;

moving means for effecting coordinated counter-rotation of the blade members from a rest position allowing passage of the strip of material and the workpiece to a cutting position in which the cutting surfaces of the blade members cooperate to snip the strip of material by a shearing action after the sewing of the strip of material to the workpiece is complete and the workpiece is moved away from the path of the blade members;

wherein said moving means includes power means and linkage means, and the linkage means includes a pair of elongated blade driving arms, pivot means, and a pair of hinge members, the blade driving arms linking the respective hinge members to the pivot means such that the power means is operable to effect counter-rotation of the hinge members upon movement of the pivot means toward the blade axis, the blade members being fixed to the respective hinge members so as to be offset with respect to the blade driving arms in a direction extending along the blade axis.

11. An improved sewing machine of the type in which a continuous strip of material is sewn to a workpiece as the workpiece is moved past a sewing needle, wherein the improvement comprises:

a pair of hinge members rotatably mounted upon the sewing machine for rotation about a common hinge axis substantially parallel to and spaced from the strip of material and adjacent to the needle;

a pair of substantially flat blade members, one blade member bing fixed to each of the hinge members so as to be perpendicular to the hinge axis, each of said blade members defining a respective cutting surface; and moving means for effecting coordinated counter-rotation of the hinge members from a rest position allowing passage of the strip of material and the workpiece to a cutting position in which the blade members cooperate to snip the strip of material by a shearing action after the sewing of the strip of material to the workpiece is complete and the workpiece is moved away from the path of the blade members, the hinge members serving as extensions of the blade members by an amount greater than the length of the cutting surfaces along the hinge axis and away from the moving means to provide off-set cutting with respect to the moving means.

12. An improved sewing machine as recited in claim 11 wherein the moving means includes power means and linkage means, and the linkage means includes a pair of elongated blade driving arms and pivot means, the blade driving arms linking the respective hinge members to the pivot means such that the power means is effective to effect counter-rotation of the hinge members upon movement of the pivot means toward the hinge axis.

13. An improved sewing machine as recited in claim 11 wherein each of the cutting surfaces is directed substantially radially with respect to the hinge axis.

14. An improved sewing machine as recited in claim 11 wherein each of the blade members defines a respective alternate cutting surface, wherein both the cutting surfaces and the alternate cutting surfaces are directed substantially radially with respect to the hinge axis such that each of the blade members is reversible about the hinge axis so as to permit shearing of the strip of material by the alternate cutting surface.

* * * * *